US008726416B2

(12) United States Patent
Roblejo

(10) Patent No.: US 8,726,416 B2
(45) Date of Patent: May 20, 2014

(54) LAB COAT ARTICLE AND METHOD

(71) Applicant: Conrad Roblejo, Marlton, NJ (US)

(72) Inventor: Conrad Roblejo, Marlton, NJ (US)

( * ) Notice: Subject to any disclaimer, the term of this patent is extended or adjusted under 35 U.S.C. 154(b) by 0 days.

(21) Appl. No.: 13/657,333

(22) Filed: Oct. 22, 2012

(65) Prior Publication Data

US 2014/0109288 A1 Apr. 24, 2014

(51) Int. Cl.
*A41D 1/00* (2006.01)

(52) U.S. Cl.
USPC ..... 2/98

(58) Field of Classification Search
USPC ..... 2/114, 115, 113, 98, 244, 101, 103, 2/DIG. 2, 60, 99, 100, 116, 127, 129, 2/130, 131, 132, 133, 134, 135, 136, 2/141.1, 141.2, 142, 143, 75, 80, 111
See application file for complete search history.

(56) References Cited

U.S. PATENT DOCUMENTS

| | | | | | |
|---|---|---|---|---|---|
| 339,920 | A | * | 4/1886 | Paulme | 2/93 |
| 379,032 | A | * | 3/1888 | Schloss | 2/100 |
| 394,270 | A | * | 12/1888 | Holmes | 2/116 |
| 958,977 | A | * | 5/1910 | Shotland | 2/85 |
| 987,971 | A | * | 3/1911 | Eaton | 2/116 |
| 1,059,542 | A | * | 4/1913 | Kaiser | 2/98 |
| 1,184,188 | A | * | 5/1916 | Lipkey | 2/60 |
| 1,322,578 | A | * | 11/1919 | Kavey | 2/96 |
| 1,548,564 | A | * | 8/1925 | Stern | 2/98 |
| 1,606,920 | A | * | 11/1926 | Bornstein | 2/116 |
| 1,691,717 | A | * | 11/1928 | Hofer | 2/93 |
| 1,729,787 | A | * | 10/1929 | Merola | 2/93 |
| 1,876,529 | A | * | 9/1932 | Wallmuth | 2/51 |
| 1,931,331 | A | * | 10/1933 | Staw | 2/95 |
| 2,079,877 | A | * | 5/1937 | Rosenwasser | 2/98 |
| 2,090,724 | A | * | 8/1937 | Drumm | 2/130 |
| 2,138,041 | A | * | 11/1938 | Preston | 2/93 |
| 2,166,566 | A | * | 7/1939 | Giuseffi | 2/98 |
| 2,174,831 | A | * | 10/1939 | Muller | 112/424 |
| 2,212,719 | A | * | 8/1940 | Prouty | 2/93 |
| 2,273,742 | A | * | 2/1942 | Weinberg | 2/98 |
| 2,318,829 | A | * | 5/1943 | Zimmerman | 2/93 |
| 2,332,734 | A | * | 10/1943 | Lucas et al. | 2/93 |
| D155,381 | S | * | 10/1949 | Black | D2/842 |
| 2,514,646 | A | * | 7/1950 | Johnson | 2/60 |
| 2,535,205 | A | * | 12/1950 | Harry | 2/98 |
| 2,647,262 | A | * | 8/1953 | Crothers | 2/116 |
| 2,688,136 | A | * | 9/1954 | Freedman | 2/105 |
| 2,711,539 | A | * | 6/1955 | Loscher | 2/93 |
| 3,002,193 | A | * | 10/1961 | Briskman | 2/72 |
| 3,067,429 | A | * | 12/1962 | Centore | 2/98 |
| 3,127,617 | A | * | 4/1964 | Bonzi | 2/96 |
| 3,147,490 | A | * | 9/1964 | Allen et al. | 2/84 |
| 3,428,963 | A | * | 2/1969 | Centeck | 2/133 |
| 3,430,264 | A | * | 3/1969 | Beukenkamp, Jr. | 2/116 |
| 3,488,775 | A | * | 1/1970 | Dickenherr | 2/98 |
| 3,651,519 | A | * | 3/1972 | Glick | 2/132 |

(Continued)

*Primary Examiner* — Alissa L Hoey
(74) *Attorney, Agent, or Firm* — Michael B. Fein, Esq.; Eckert Seamans Cherin & Mellott, LLC

(57) ABSTRACT

An article in the form of a lab coat having body comprising left and right lapels having outside edges which are stitched to the body of the lab coat and can be used by a medical professional while wearing a stethoscope so that the stethoscope does not interfere with the lapels. Articles which exclude a fold down collar and which include lapels of color and/or design different from the body of the lab coat are also disclosed.

3 Claims, 1 Drawing Sheet

(56) References Cited

U.S. PATENT DOCUMENTS

| | | | | | |
|---|---|---|---|---|---|
| 3,725,954 | A | * | 4/1973 | Baldini | 2/143 |
| 3,827,084 | A | * | 8/1974 | Seta | 2/98 |
| 4,077,065 | A | * | 3/1978 | Wactor | 2/93 |
| 4,651,347 | A | * | 3/1987 | Brown | 2/60 |
| 4,653,119 | A | * | 3/1987 | Kaiser | 2/60 |
| 4,947,867 | A | * | 8/1990 | Keeton | 128/846 |
| 4,953,232 | A | * | 9/1990 | Gaines et al. | 2/60 |
| 5,084,914 | A | * | 2/1992 | Hesch | 2/79 |
| 5,138,715 | A | * | 8/1992 | Baustin | 2/96 |
| 5,626,267 | A | * | 5/1997 | Peruski | 223/84 |
| 5,694,651 | A | * | 12/1997 | Thomas | 2/69 |
| 5,711,030 | A | * | 1/1998 | Anderson et al. | 2/60 |
| 5,761,744 | A | * | 6/1998 | Horvat et al. | 2/129 |
| 5,771,491 | A | * | 6/1998 | Bennett et al. | 2/98 |
| 5,864,879 | A | * | 2/1999 | Bercane | 2/93 |
| 5,940,882 | A | * | 8/1999 | Auguste | 2/60 |
| 5,956,769 | A | * | 9/1999 | Stepney | 2/129 |
| 6,058,512 | A | * | 5/2000 | Miyawaki | 2/244 |
| 6,226,905 | B1 | * | 5/2001 | Osuna | 40/1.6 |
| 6,260,200 | B1 | * | 7/2001 | Alfred | 2/69 |
| 6,698,025 | B1 | * | 3/2004 | Hughes | 2/69 |
| 6,836,901 | B2 | * | 1/2005 | Hippensteel | 2/60 |
| 7,080,413 | B1 | * | 7/2006 | Schneider | 2/60 |
| D527,168 | S | * | 8/2006 | Gould Rubin et al. | D2/717 |
| 7,770,236 | B2 | * | 8/2010 | Gulisano | 2/98 |
| 8,156,573 | B2 | * | 4/2012 | Gandy | 2/84 |
| 8,312,564 | B2 | * | 11/2012 | Beshlian | 2/46 |
| 2003/0093850 | A1 | * | 5/2003 | Peterkin | 2/60 |
| 2003/0221244 | A1 | * | 12/2003 | Liddell | 2/244 |
| 2004/0117889 | A1 | * | 6/2004 | Shultz et al. | 2/69 |
| 2005/0102734 | A1 | * | 5/2005 | Daniel et al. | 2/239 |
| 2007/0028344 | A1 | * | 2/2007 | Czajka | 2/51 |
| 2007/0095234 | A1 | * | 5/2007 | Hopman | 101/483 |
| 2009/0300820 | A1 | * | 12/2009 | Cansler et al. | 2/114 |
| 2010/0064407 | A1 | * | 3/2010 | Beshlian | 2/48 |
| 2010/0199404 | A1 | * | 8/2010 | Garza | 2/84 |
| 2010/0299810 | A1 | * | 12/2010 | Snyder | 2/244 |
| 2011/0107494 | A1 | * | 5/2011 | Haines | 2/48 |
| 2011/0289644 | A1 | * | 12/2011 | Beshlian | 2/46 |

* cited by examiner

LAB COAT ARTICLE AND METHOD

BACKGROUND OF THE INVENTION

The present invention relates to lab coats of the type worn by medical professionals.

Conventional lab coats are white and have collars and lapels which are similar to collars and lapels on men's and women's suit jackets insofar as collars and lapels are cut from the same cloth as the body of the coat and folded over.

Medical professionals often drape a stethoscope around their collar and lapels. Very often the draping of the stethoscope causes the lapel of the lab coat to fold and crinkle when the stethoscope is used or moved.

Traditional lab coats often have the medical professional's hospital department such as surgery, radiology, critical care, for example, sewn or embroidered on the body of the lab coat. The sewn or embroidered department identification is often hard to read or seen.

It is an object of the present invention to avoid the folding, crinkling, and other interference caused by a stethoscope when worn on a lab coat.

It is also an object of the present invention to improve on the traditional hospital department identification system.

SUMMARY OF THE INVENTION

These objects, and others as will become apparent from the following disclosure and accompanying drawings, are achieved by the present invention which comprises in one aspect a lab coat comprising sewn down or ironed on lapels.

In some embodiments the lab coat has no collar or a sewn down collar.

In preferred embodiments the lapels of the lab coat include color and/or design indicia corresponding to a particular department, specialty, or other identification so that in a particular hospital or other medical facility setting, the color and/or design of the lapels functions to identify, for example, the department or specialty of the wearer.

In some embodiments the lapels are cut from different cloth than the body of the lab coat. The cloth from which the lapels are cut can be colored and/or include design indicia while the body of the lab coat can be traditional white, for example.

While it is preferred that the back of the lab coat does not have a collar because a folded down collar has been found to interfere with stethoscopes, in some less preferred embodiments the lab coat can include a sewn down collar, for example cut from the same material as the lapels in some embodiments or as part of a unitary member comprising the collar and the lapels, in which case it is preferred that the unitary collar-lapels member be sewn along the outer edges of the lapels and the outer edge of the collar or ironed on to the body of the lab coat. In some embodiments the lapels, which may or may not include an integral collar, are fastened to the lab coat by means other than stitching or ironing on.

DETAILED DESCRIPTION

Figure 1:
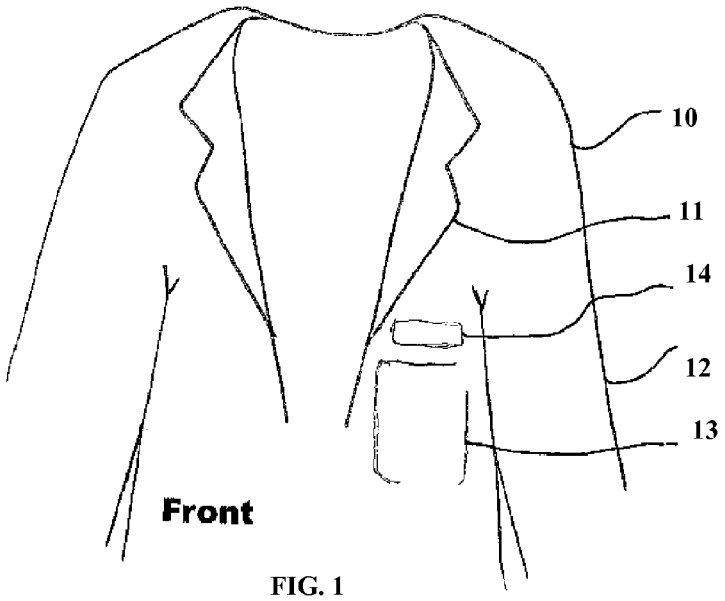
FIG. 1 is a front perspective view of a conventional prior art lab coat.

Referring now to the drawings, FIG. 1 illustrates a conventional lab coat 10 of the type traditionally worn by medical professionals. The traditional lab coat 10 includes folded down lapels 11 and a folded down collar which is not visible in this view. This traditional lab coat also includes an identification tag 14 which is either sewn onto the left side of the body of the coat above the pocket 13, or is embroidered onto such location.

Figure 2:
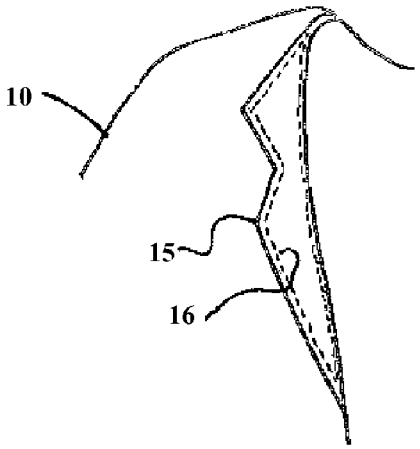
FIG. 2 is a front perspective view of one lapel according to the invention illustrating the stitching along the entire edge of the lapel.

An embodiment of a coat 10 according to the invention illustrated in FIG. 2 includes a separate lapel 15 which is sewn onto the coat with stitches 16 around all sides of the lapel 15.

Figure 3:
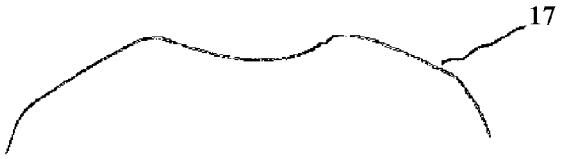
FIG. 3 is a rear perspective view of the top of one embodiment of a lab coat according to the invention illustrating the absence of a folded down collar.

FIG. 3 illustrates the top back 17 of a coat according to the invention which has no collar and is thus not subject to being crinkled or wrinkled or interfered with by a stethoscope.

Figure 4:
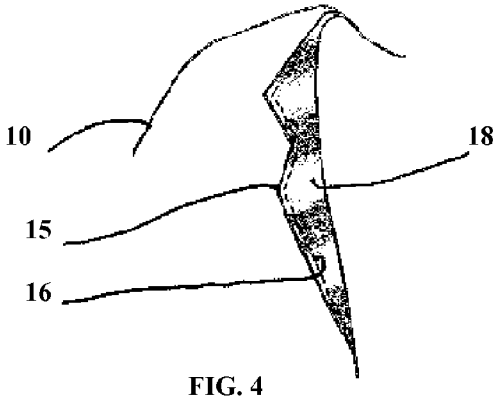
FIG. 4 is a front perspective view of one lapel according to the invention illustrating a design feature which functions as an indicia of a hospital department on a lapel and stitching along the entire edge of the lapel.

FIG. 4 illustrates a coat 10 according to the invention with lapel 15 having a striped design 18 and stitches 16 around the outer perimeter of the lapel.

In some embodiments the sleeves include cuffs or edges which include color and/or design features corresponding to those of the lapels.

In some embodiments the lapels having color and/or design indicia are ironed on or fastened to the body of the lab coat by means other than sewing.

It has been found experimentally that a stethoscope can be worn by a person who is wearing a lab coat according to the invention without interference from a lapel or, in some embodiments, from a collar, which overcomes a problem with traditional lab coats which require frequent straightening of lapels and collars which are wrinkled or crinkled by stethoscopes.

The present invention, therefore, is well adapted to carry out the objects and attain the ends and advantages mentioned, as well as others inherent therein. While the invention has been depicted and described and is defined by reference to particular preferred embodiments of the invention, such references do not imply a limitation on the invention, and no such limitation is to be inferred. The invention is capable of considerable modification, alteration and equivalents in form and function, as will occur to those ordinarily skilled in the pertinent arts. The depicted and described preferred embodiments of the invention are exemplary only and are not exhaustive of the scope of the invention. Consequently, the invention is intended to be limited only by the spirit and scope of the appended claims, giving full cognizance to equivalents in all respects.

What is claimed is:

1. A lab coat consisting of:

a body, a collar and left and right lapels;

the body having a left front panel and a right front panel, the left front panel and the right front panel each having a terminal edge, the body having a garment opening between the left terminal edge and the right terminal edge;

each of the left and right lapels having an inner side edge and outside edges forming a periphery, the inner side edge of the left and right lapel are attached to the body, the outside edges of the left lapel are completely stitched to the left front panel body of the lab coat and the outside edges of the right lapel are completely stitched to the right front panel body of the lab coat;

the collar includes an inside edge and an outside edge, the inside edge of the collar is attached to the body of the lab coat, and the outside edge of the collar is stitched to the body of the lab coat;

wherein the collar and lapels are integral and cut form a single piece of cloth; and wherein the left and right lapels include a material having a color and/or design which is different from a color and/or design of the body of the lab coat.

2. The article of claim 1 wherein the lapels are cut from different materials than the body of the lab coat.

3. A method of identifying membership of a medical professional in a particular department of a hospital comprising providing a lab coat according to claim 1 for the medical professional to wear wherein the color and/or design of the lapels material corresponds to the particular department and identifies the medical professional as being associated with or a member of the particular department.

* * * * *